United States Patent [19]

Feuring

[11] Patent Number: 4,694,879

[45] Date of Patent: Sep. 22, 1987

[54] PROCESS FOR PRODUCING CASTINGS

[75] Inventor: Kurt Feuring, Solms-Niederbiel, Fed. Rep. of Germany

[73] Assignee: Buderus Aktiengesellschaft, Wetzlar, Fed. Rep. of Germany

[21] Appl. No.: 787,801

[22] PCT Filed: Apr. 17, 1985

[86] PCT No.: PCT/DE85/00121

§ 371 Date: Oct. 1, 1985

§ 102(e) Date: Oct. 1, 1985

[87] PCT Pub. No.: WO85/04826

PCT Pub. Date: Nov. 7, 1985

[30] Foreign Application Priority Data

Apr. 21, 1984 [DE] Fed. Rep. of Germany ..... 3415232

[51] Int. Cl.[4] ..... B22C 7/02; B22C 9/04

[52] U.S. Cl. ..... 164/7.2; 164/7.1; 164/34; 164/44; 164/45; 164/246; 164/249

[58] Field of Search ..... 164/7.1, 7.2; 34, 35, 164/36, 44, 45, 160.1, 160.2, 246, 249

[56] References Cited

U.S. PATENT DOCUMENTS

| | | | |
|---|---|---|---|
| 3,063,113 | 11/1962 | Operhall et al. | 164/45 |
| 3,552,480 | 1/1971 | Harris | 164/245 |
| 3,624,758 | 11/1971 | Harris | 164/245 X |
| 3,842,899 | 10/1974 | Hauser-Lienhard | 164/324 X |

FOREIGN PATENT DOCUMENTS

| | | | |
|---|---|---|---|
| 1917893 | 6/1965 | Fed. Rep. of Germany . | |
| 2507509 | 8/1976 | Fed. Rep. of Germany | 164/34 |
| 51-23369 | 7/1976 | Japan | 164/7.1 |
| 2059315 | 4/1981 | United Kingdom . | |

*Primary Examiner*—J. Reed Batten, Jr.

*Attorney, Agent, or Firm*—Karl F. Ross; Herbert Dubno

[57] ABSTRACT

A process for production of castings is provided employing patterns combining gasifiable pattern parts, for the creation of nonconforming contours, with reusable pattern parts. After molding, only the reusable pattern parts are removed from the mold, while the gasifiable pattern parts are destroyed during casting.

2 Claims, 4 Drawing Figures

PROCESS FOR PRODUCING CASTINGS

FIELD OF THE INVENTION

The invention relates to a process for producing castings with partially nonconforming contours.

BACKGROUND OF THE INVENTION

For molding nonconforming contours, which means undercuts in the mold it is common to work with loose parts. After the removal of the main part of the pattern, these are drawn into the created hollow space of the mold and then also removed, in order to be reassembled with the main part of the pattern. In the case of relatively narrow molds loose parts can not be used since the hollow space of the mold is not sufficiently wide. Here, separate cores have to be inserted in the produced mold.

Another possibility for molding nonconforming contours is offered by the technique according to which gasifiable models fill the mold. Hereby, the model within the mold is destroyed before or during casting. The application of this process is limited by the stability of the synthetic foam to be used which opposes relatively low resistance during the hardening of the molding material. This can lead to distortions and dimensional aberrations of the castings. For each casting a new model has to be made which then is completely gasified. Relatively large gas quantities have to be evacuated during the casting. The residues on the surface of the casting can deteriorate the quality of the casting.

Accordingly, it is the object of this invention to provide a process in which castings with nonconforming contours can be produced without the aforementioned disadvantages.

SUMMARY OF THE INVENTION

The foregoing objects have been achieved by a method wherein there is employed a pattern having a combination of gasifiable pattern parts for the molding of nonconforming contours and of reusable pattern parts. After molding, only the reusable pattern parts are withdrawn from the mold whereas the gasifiable pattern parts are destroyed during casting. More specifically, the method is intended for producing cast products with ribs. The pattern employed therefor has ribs with L- and/or T-shaped cross sections. In this method, only the vertical rib webs are withdrawn from the mold after molding and utilized as reusable pattern parts. Horizontal rib flanges are destroyed as gasifiable pattern parts during casting.

A further aspect of the invention is the use of a pattern made of gasifiable and reusable pattern parts which is covered with a foil embedded in a binder free molding material. The so-obtained mold is connected to a vacuum source prior to the removal and construction of the pattern parts.

The present invention retains advantages of both the known methods wherein both reusable and gasifiable patterns are used. Yet, in comparison to the method in which the mold is filled with gasifiable models, the precise dimensioning is ensured here because the functional dimensions, the conforming contours and the support parts for the gasifiable pattern segments are made of inherently stable materials. It is not necessary to gasify large volumes during casting. The flowability of the metal is improved thereby, since it is opposed by reduced gas pressure and the gases can be more easily evacuated. Also, the residues in the hollow space of the mold are reduced, improving considerably the surface of the casting. Besides, the efforts and the costs related to the hereto known process for the production of molds filled with patterns are considerably reduced.

In comparison with the known molding technique wth reusable patterns possibilities to shape forms which come closer to the requirements are created, since the method is not tied down to conformity. Loose parts which have to be then removed from the mold can be eliminated. Contours which are technically quite difficult to produce can be easily manufactured without cores. This leads to reduction of production costs and to the elimination of error sources.

The process according to the invention reaches its full advantage when used in combination with the known vacuum molding technique. This molding process is suitable for the production of castings requiring high-precision dimensioning, also in the case of larger dimensions, since the molding material can easily be packed to a dense core through vibrations, due to the absence of binders. The high degree of compression does not allow the use of larger models in the cavity of the mold. Besides, the instability of the material for models leads to castings with reduced dimensional precision.

For the here-proposed combined technique the vacuum molding process is on the contrary particularly well suited. The relatively small gasifiable model parts are only minimally deformed under high pressures. On the other hand, they create the possibility of casting without loose parts and cores, which is connected to certain problems in the case of the vacuum process.

BRIEF DESCRIPTION OF THE DRAWING

The above and other objects, features and advantages of the present invention will become more readily apparent from the following description, reference being made to the accompanying diagrammatic drawing in which.

DESCRIPTION

Figure 1:
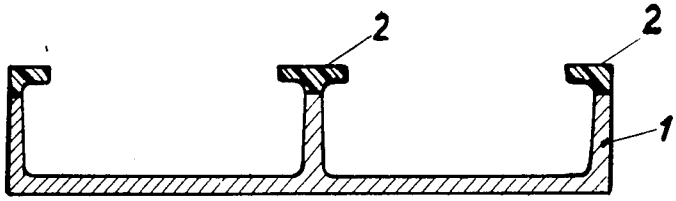
FIG. 1 is a cross section through a pattern.

The castings of the invention have ribs characterized by L- and T-shaped cross sections. Conforming contours of vertical rib webs are constructed as reusable pattern parts 1. Nonconforming contours of horizontal rib flanges form gasifiable model parts 2. The gasifiable model parts 2 are positioned on the pattern parts 1 so that the latter can be withdrawn vertically in the usual manner from the mold after molding. The pattern represented in the drawing shows a preferred embodiment. Of course, any other kind and shape of model parts 1, 2 is conceivable. The gasifiable model parts 2 can be positioned laterally with respect to the reusable pattern parts 1 or can surround these.

Figure 2:
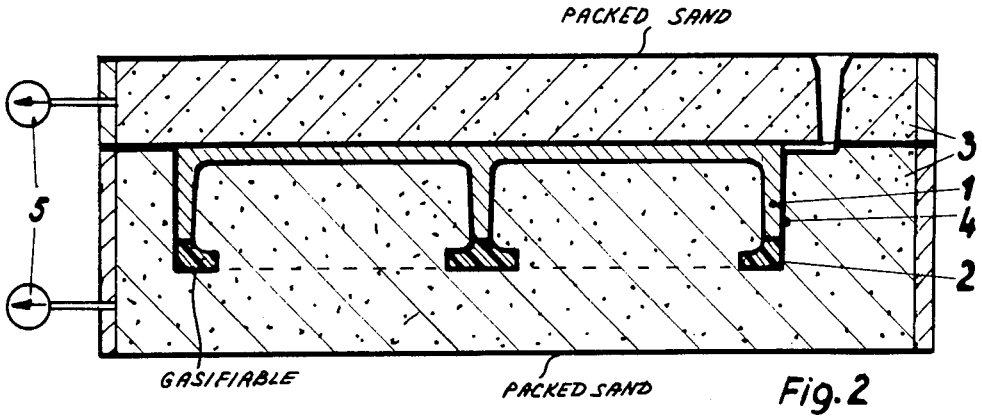
FIG. 2 is a cross section through a mold with inserted pattern.

The pattern according to FIG. 1 is imbedded in mold 3 as shown in FIG. 2. In order to apply the vacuum mold-forming process the pattern is covered with foil 4. A vacuum source 5 is then connected to the mold 3.

Figure 3:
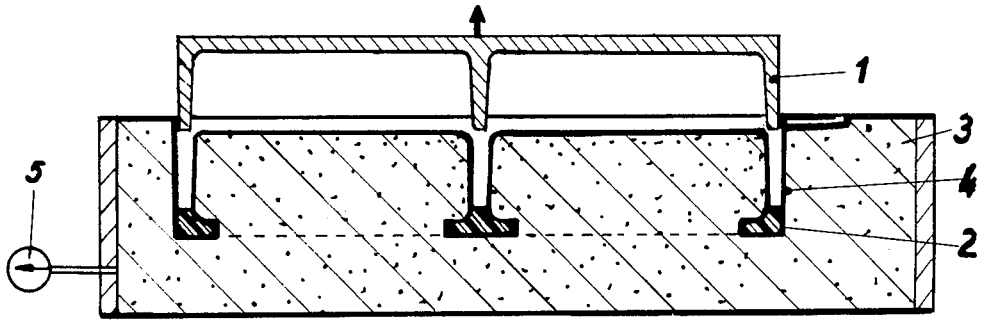
FIG. 3 is a cross section through a half of the mold during the removal of the pattern.
Figure 4:
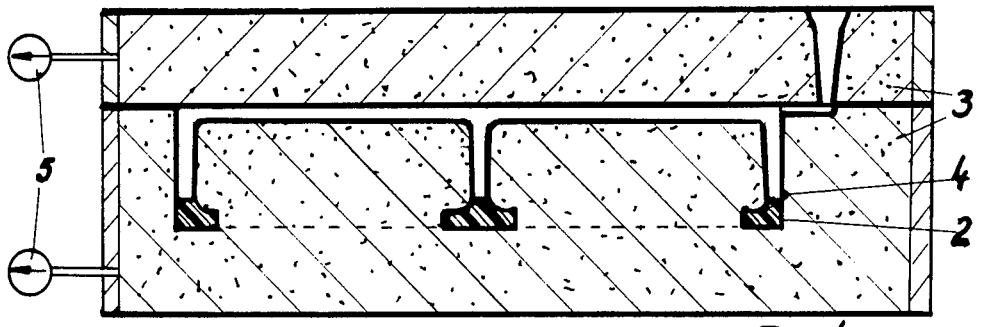
FIG. 4 is a cross section through the finished mold before casting.

According to FIG. 3, only the reusable pattern parts 1 with the conforming contours are withdrawn from the mold. The gasifiable pattern parts 2 stay in the mold 3, which is shown in its final stage in FIG. 4. They are destroyed during casting by the fluid melt. In the case of the previously known methods, it would have been necessary to either develop a conforming construction or to use loose parts known as cores. The purely conforming patterns would have had the afore-described disadvantages. Besides, they would have been much too expensive for continuous production.

I claim:

1. A method for producing a casting having at least one vertical rib when a cross-sectional shape selected from L-, T- and combination shapes thereof, said method comprising:

providing a pattern for said casting said pattern being a combination of reusable and gasifiable parts, said reusable parts comprising a base element, and at least one vertical rib web attached thereto which is substantially perpendicular to said base element, said gasifiable parts comprising at least one horizontal rib flange connected to said rib web, a portion of said rib flange formed at an angle to said rib web;

molding a binder free molding material around said pattern to form a mold;

removing said reusable parts of said pattern from said mold; and destroying said gasifiable parts of said pattern during introduction of casting material into said mold.

2. A method according to claim 1 further comprising covering said gasifiable and reusable parts with a foil, embedding said foil covered parts in the binder free molding material, and connecting said mold to a vacuum source prior to the removal and destruction of the reusable and gasifiable parts, respectively.

* * * * *